United States Patent [19]

Silver

[11] 4,454,650

[45] Jun. 19, 1984

[54] UPPER JAW AND TOOL ASSEMBLY FOR FASTENER ATTACHING MACHINE

[75] Inventor: Bernard R. Silver, Cranston, R.I.

[73] Assignee: U.S. Industries, Inc., New York, N.Y.

[21] Appl. No.: 410,867

[22] Filed: Aug. 23, 1982

[51] Int. Cl.[3] ..... B23Q 7/10; B23P 17/00; B23P 11/00; A41H 37/04

[52] U.S. Cl. ..... 29/818; 29/798; 29/432; 227/15; 227/18

[58] Field of Search ..... 29/818, 706, 798, 809, 29/822, 432, 432.1, 432.2; 227/15, 18, 281.1

[56] References Cited

U.S. PATENT DOCUMENTS

| | | | |
|---|---|---|---|
| 2,992,431 | 7/1961 | Jensen | 227/15 |
| 3,225,993 | 12/1965 | Hall | 227/18 |
| 3,612,382 | 10/1971 | Littell | 227/18 |
| 3,632,033 | 1/1972 | Schmidt | 227/18 |
| 3,750,925 | 8/1973 | Schmidt et al. | 227/18 |
| 4,007,537 | 2/1977 | Silverbush et al. | 29/809 |
| 4,090,652 | 5/1978 | Silverbush | 29/281.1 |

*Primary Examiner*—Howard N. Goldberg
*Assistant Examiner*—Steven E. Nichols
*Attorney, Agent, or Firm*—Salter & Michaelson

[57] ABSTRACT

An upper jaw and tool assembly for a machine for attaching snap fastener components to fabric is operable to safely receive and advance upper fastener component halves for the assembly thereof with lower component halves. A stationary housing of the assembly is mountable on an attaching machine so that the lower end of the housing is spaced only slightly above the guide plate of the machine to minimize operator risks from internal moving components of the assembly. Fingers mounted on the housing receive and position successively fed upper component halves therein and an upper tool continuously advances the halves downwardly to assemble them with lower component halves. The assembly operates without conventional vertically reciprocating jaw components and hence can be operated with a minimum of operator risks.

10 Claims, 8 Drawing Figures

UPPER JAW AND TOOL ASSEMBLY FOR FASTENER ATTACHING MACHINE

BACKGROUND AND SUMMARY OF THE INVENTION

The instant invention relates to fastener attaching machines of the type utilized for assembling fastener component halves in the attachment of fastener components to fabrics and the like.

Snap fasteners are widely used in a variety of industries, including the garment industry, for detachably interconnecting various elements, such as fabrics and the like. The most common types of snap fasteners comprise detachably interfitting individual male and female components which comprise pairs of permanently assembled component halves.

Automatic attaching machines are currently used in most commercial applications for assembling component halves of the above described type while attaching same to fabrics and the like. In this regard, the attaching machine marketed by Rau Fastener Company, Division of U.S. Industries, Inc. as Automatic Attaching Machine Model 6N, is exemplary of one type of attaching machine which is in wide use. Machines of this general type are operable to assemble component halves into permanently interfitted relation on opposite surfaces of pieces of fabric and the like and include upper and lower fastener tools which cooperatively engage the halves to effect the assembly thereof through reciprocating movement of the upper tool toward and away from the lower tool. Machines of this type also include upper and lower feed assemblies which feed upper and lower component halves to the upper and lower tools, respectively, and a guide plate for supporting pieces of fabric or the like adjacent to the lower tool. Conventional machines of this type also include upper jaws which continuously receive the upper component halves from the upper feed assembly and reciprocate with the upper tool to continuously position the upper component halves in desired aligned relation on the fabric for the assembly of the upper halves with lower halves as the upper tool is advanced to its lowermost position.

When operating a machine of the above described type, it is generally necessary for operators to hold pieces of fabric or other material on the guide plates of the machines in order to assure that the fastener component halves are assembled at the desired positions. Further, in order to assure that the halves are assembled in precisely the desired locations, it is frequently necessary for operators to move their fingers into close proximity with the respective upper and lower tools of the machines, making the operation of such machines potentially quite hazardous. These hazards are further compounded by the fact that machines of this type are operable to assemble as many as three fastener components per second and therefore the upper tool and jaw assemblies thereof necessarily move quite rapidly in their reciprocating movement. Conventional fastener attaching machines have included a variety of types of shields in order to reduce these safety hazards, but most of the known shield arrangements have either been ineffective from a safety standpoint or have restricted access to the tools to the point that they have made it impossible for operators to precisely position pieces of fabric in desired orientation to receive the component halves.

The instant invention provides a novel construction for an upper jaw and tool assembly for a fastener component attaching machine which overcomes the above described disadvantages. More specifically, the subject invention provides an upper jaw and tool assembly which receives and positions upper fastener component halves in proper orientation, but which operates without external reciprocating components and hence is substantially less hazardous than the jaw assemblies of the prior art machines. In this connection, the jaw and tool assembly of the instant invention comprises a stationary housing having a longitudinal passage therethrough, a feed opening in the rear side thereof, and an upper tool which is adapted to travel in the passage. The housing is dimensioned so that when the assembly is mounted on an attaching machine, the lower end of the housing is spaced slightly above the lower tool and the guide plate so that there is sufficient clearance (approximately ¼ inch in most instances) to receive a fabric therebetween, but so that there is insufficient room for an operator's fingers to be inadvertently positioned therebetween. The assembly further comprises a pair of inwardly biased jaw members which are pivotally mounted on opposite sides of the housing and retaining means on the upper tool for temporarily receiving and retaining successive upper component halves thereon. In operation, the upper component halves are continuously fed through the feed opening and are received in the jaw members. Each time the upper tool travels downwardly in the passage, it receives an upper component half from the jaw members and advances the half downwardly while urging the ends of the jaw members outwardly. The upper tool finally passes out of the lower end of the passage carrying the upper component half with it and assembles the half with a lower component half supported by the lower tool. Because of the unique cooperation of the jaws and the upper tool within the housing, the upper component halves can be assembled with the lower halves without requiring a conventional reciprocating jaw assembly, and hence the safety problems associated with such reciprocating assemblies are effectively eliminated. In addition, the necessity of having an external safety shield is also eliminated so that an operator can position a fabric or the like in precisely the desired position adjacent the lower tool without encountering serious risks.

Accordingly, it is a primary object of the instant invention to provide a jaw assembly for a fastener attaching machine which permits safe and accurate assembly of fastener component halves in the attachment thereof to fabrics and the like.

Another object of the instant invention is to provide a jaw assembly for a fastener component attaching machine which remains substantially stationary during the operation thereof.

A still further object of the instant invention is to eliminate the necessity for utilizing a safety shield around the jaws of a fastener component attaching machine.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
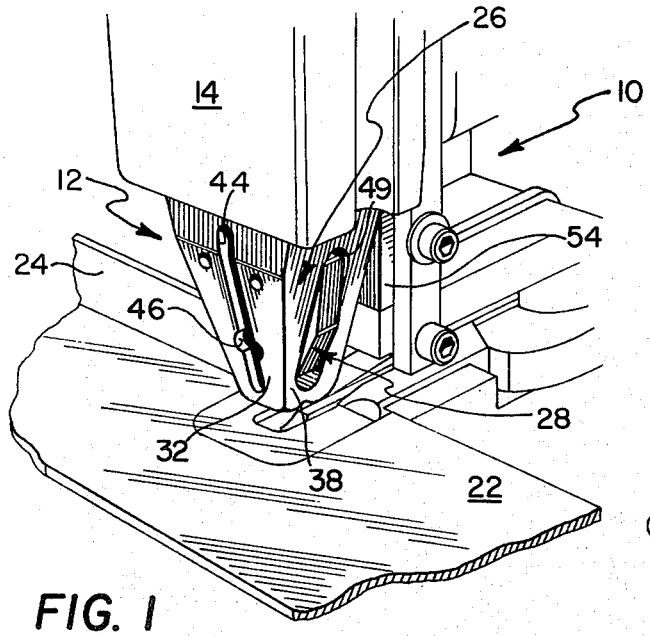
FIG. 1 is a fragmentary perspective view of a fastener machine which includes the upper jaw and tool assembly of the instant invention.
Figure 2:
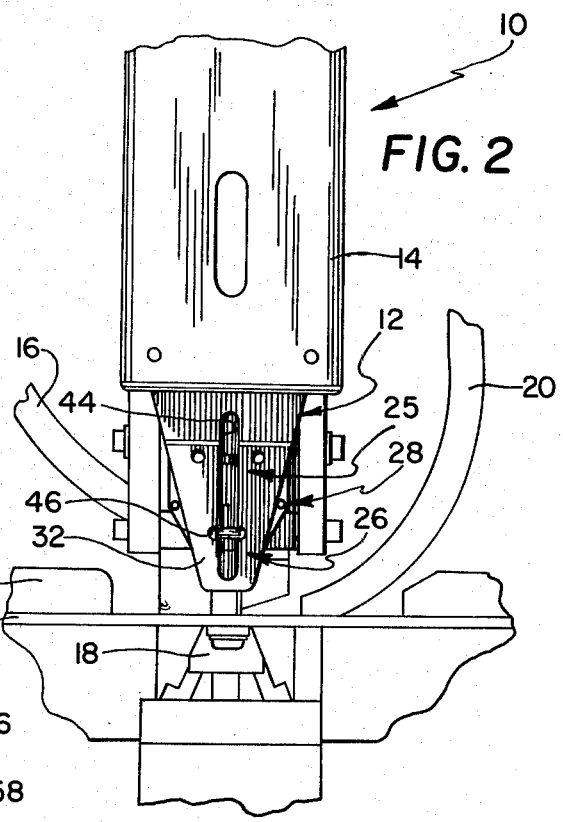
FIG. 2 is a front elevational view thereof.
Figure 3:
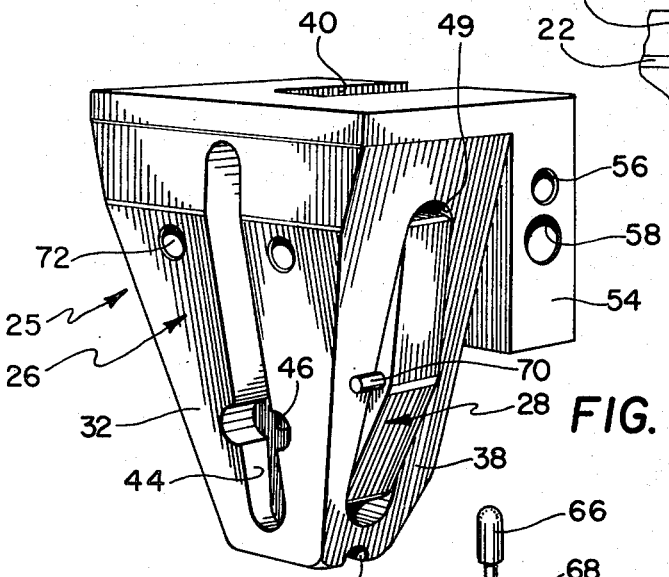
FIG. 3 is an enlarged perspective view of the upper jaw assembly per se.
Figure 4:
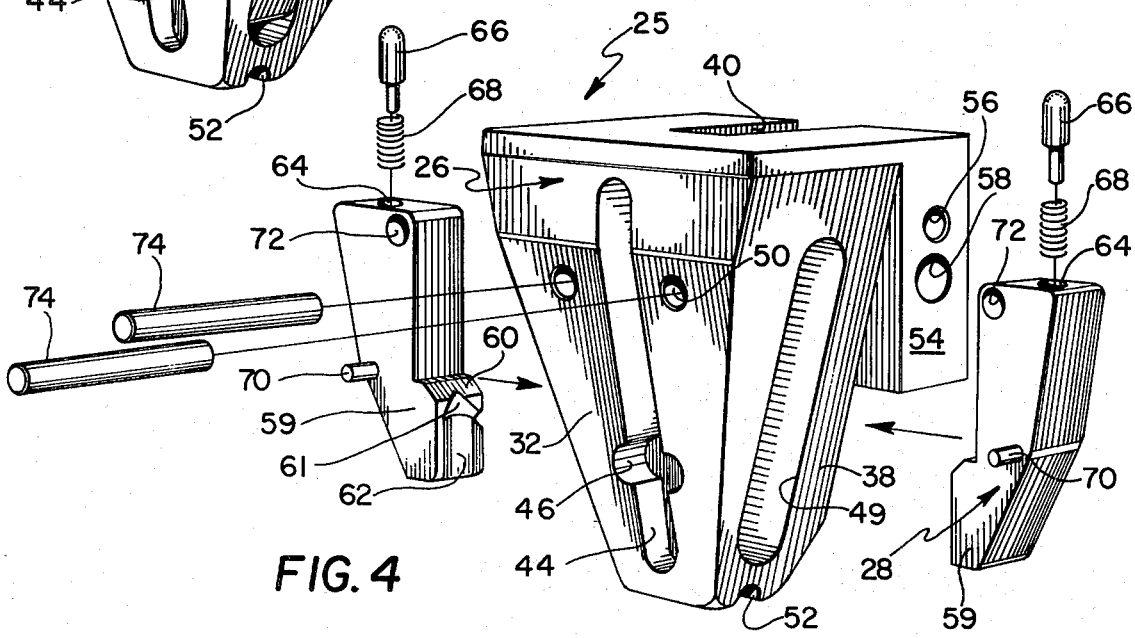
FIG. 4 is an exploded perspective view thereof.

Referring now to the drawing, particularly FIGS. 1 and 2, the fastener attaching machine of the instant invention is illustrated and generally indicated at 10. The machine 10 includes an upper tool and jaw assembly which is generally indicated at 12, an upper head 14, and an upper feed assembly 16 which is operable to feed upper fastener component halves to the tool and jaw assembly 12. Also included in the machine 10 are a lower tool and jaw assembly 18 which is disposed in aligned relation with the upper tool and jaw assembly 12, a lower feed assembly 20 which is operable to continuously feed lower fastener component halves to the lower assembly 18, and a guide plate 22 having an upstanding back wall 24. The machine 10, exclusive of the upper tool and jaw assembly 12, may be the type of machine marketed by the Rau Fastener Company, Division of U. S. Industries, Inc., as a Model 6N Automatic Attaching Machine. The machine 10, as embodied with the upper tool and jaw assembly 12, is operable to safely and accurately effect the assembly of upper and lower fastener component halves on opposite sides of a fabric and the like for the attachment of fastener components thereto in rapid succession, or substantially as rapidly as the operator can reposition the fabric.

The jaw and tool assembly 12 comprises a jaw assembly 25 which includes a housing 26, a pair of inwardly biased fingers 28 which are pivotally mounted on the housing 26 and an upper tool 30 which travels within the housing 26. The housing 26 is preferably made of a suitable metal such as aluminum in a generally downwardly tapered four sided configuration having front and rear walls 32 and 34, respectively, and side walls 36 and 38. A central longitudinal passage 40 extends downwardly through the rear wall 34. An elongated longitudinal slot 44 having an enlarged portion 46 extends through the front wall 32 and communicates with the passage 40, while elongated longitudinal slots 48 and 49 extend through the side walls 36 and 38, respectively, also communicating with the passage 40. Bores 50 extend rearwardly through the housing 26 on opposite sides of the slot 44 and are disposed so that they communicate with the slots 48 and 49, respectively, slightly below the upper edges thereof. A groove 52 extends transversely across the lower end of the housing 26 and a mounting block 54 having mounting holes 56 and 58 therein is provided on the rear of the housing 26 for the mounting thereof on the head 14. The upper tool and jaw assembly 12 is dimensioned so that when it is mounted on the head 14, the lower end of the housing 26 is normally spaced approximately ¼ inch above the guide plate 22 although on some machines the guide plates thereof may be slightly adjustable to increase this spacing to as much as ⅜ inch.

The fingers 28 comprise elongated members which are dimensioned to be received in the slots 48, 49 and include inwardly extending jaw elements 59 on the lower portions thereof. The jaw elements 59 have downwardly bevelled upper surfaces 60, arcuate transverse notches 61 which are disposed slightly below the surfaces 60, and arcuate longitudinal grooves 62 which extend downwardly from the surfaces 60 to the lower ends of the jaw elements 59. Bores 64 extend downwardly a distance from the upper surfaces of the fingers 28 and round nosed pins 66 with coil springs 68 received on the reduced lower ends thereof are received in the bores 64. Outwardly extending stop pins 70 are provided on the fingers 28 adjacent the outer edges thereof and bores 72 are provided in the fingers 28 adjacent the uppermost inner corners thereof.

In the assembly 25, the fingers 28 are pivotally mounted in the housing 26 so that the lower ends of the fingers 28 are inwardly biased towards the passage 40. Specifically, the fingers 28 are mounted with pivot pins 74 which are received in the bores 50 and the bores 72 to pivotally mount the fingers 28 in the slots 48 and 49. The round nosed pins 66, which are outwardly biased by means of the springs 68, engage the upper peripheries of the slots 48 and 49 to urge the lower portions of the fingers 28 inwardly as the fingers 28 pivot on the pins 74. The stop pins 70 prevent the fingers 28 from travelling inwardly beyond a predetermined position by engaging the walls 36 and 38 as illustrated most clearly in FIG. 6.

Figure 5:
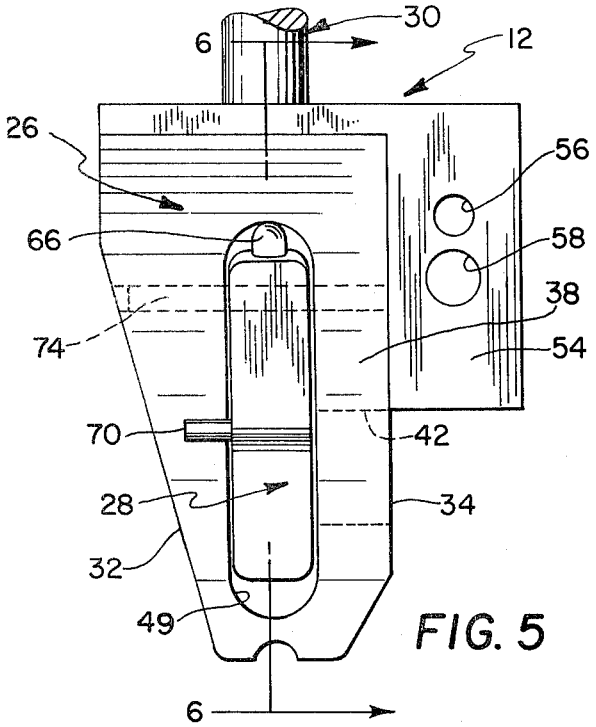
FIG. 5 is a side elevational view of the jaw and tool assembly.
Figure 6:
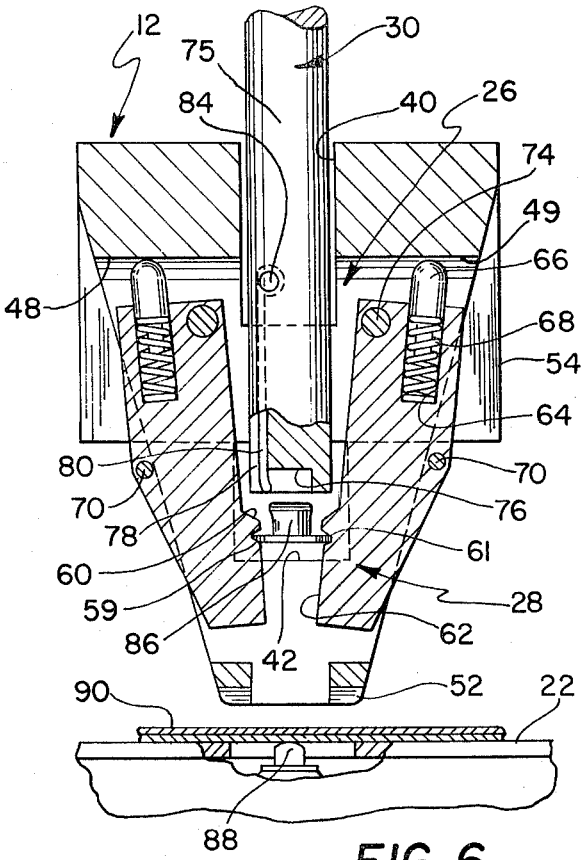
FIG. 6 is a sectional view taken along line 6—6 in FIG. 5.
Figure 7:
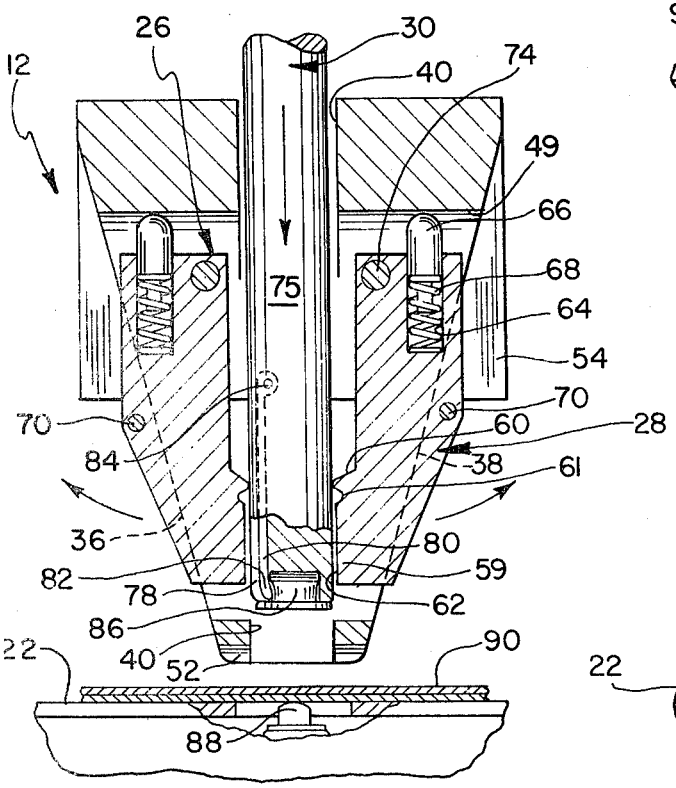
FIG. 7 is a similar view with the upper tool in a partially downwardly advanced position.

The upper tool 30 is most clearly illustrated in FIGS. 5 through 7. The tool 30 comprises an elongated cylindrical rod 75 having an axial recess 76 in the lower extremity thereof and an elongated longitudinal peripheral slot 78 which extends along the lower portion thereof. A resilient wire element 80 having an inwardly bent lower end 82 is secured to the rod 75 at 84 so that it is received in the slot 78 with the end 82 extending slightly into the recess 76. The upper end of the tool 30 extends into the head 14 where it is attached to conventional elements of the machine 10 which operate to vertically reciprocate the tool 30 in a conventional manner.

Figure 8:
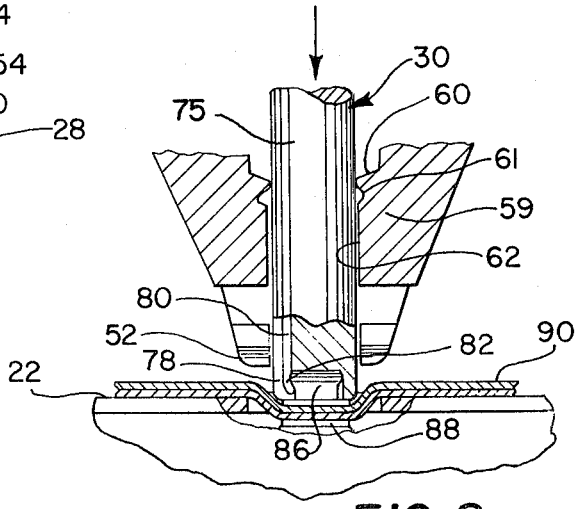
FIG. 8 is a fragmentary view thereof with the upper tool in its lowermost position.

In operation, the upper feed assembly 16 successively feeds upper component halves to the upper jaw and tool assembly 12 so that the halves are sequentially fed through the feed opening 42 and received in the notches 61 of the jaw elements 59 where they are held until they are engaged by the upper tool 30. The tool 30 then carries the halves downwardly through the housing 26 to assemble them with lower component halves. The operation of the upper tool and jaw assembly 12 as the tool 30 travels downwardly through the fingers 28 to assemble an upper component half 86 with a lower component half 88 is illustrated in FIGS. 6 through 8. Referring first to FIG. 6, it is seen that before the tool 30 begins its descent, the upper half 86 is received in the notches 61, the lower half 88 is received in the lower tool and jaw assembly 18, and a fabric 90, which may be of double thickness, as herein illustrated, is positioned in the desired orientation on the guide plate 22 between the halves 86 and 88. As the upper tool 30 is moved downwardly, the lower end thereof engages the surfaces 60 causing the fingers to be cammed slightly outwardly and thereafter the upper half is received in the recess 76 with the bent portion 82 of the wire element 80 resiliently engaging the upper portion of the upper half 86 to retain it on the lower end of the tool 30. As the tool 30 is further advanced downwardly, it travels in the grooves 62 carrying the half 86 with it, as illustrated in FIG. 7. Finally, when the lower end of the tool 30 is advanced beyond the lower end of the housing 26, the half 86 is received in assembled relation with the lower half 88 in a conventional manner with the fabric 90 interposed therebetween. The groove 52 then provides additional clearance at the lower end of the housing 26 for removal of assembled components after the tool 30 has been retracted into the housing 26. In instances where bent or misformed halves become jammed in the assembly 12, they can be removed through the enlarged portion 46 of the slot 44.

The machine 10 is capable of rapidly and safely effecting the above described fastener component assembly operation. Despite the capacity of the machine 10 to be operated at high speeds, it can be effectively operated without the operator risks associated with the machines of the prior art. Because the housing 26 is spaced only slightly above the guide plate 22, it is virtually impossible for an operator's fingers to be caught beneath the tool 30 as it descends to assemble the halves 86 and 88. This fact plus the fact that the assembly 12 does not include exposed reciprocating jaw components make the machine 10 extremely safe in its operation. Further, because the machine 10 is inherently safer in its operation than the heretofore known attaching machines, it can be safely operated without a safety shield or safety guard. Consequently, an operator of the machine 10 can move his or her fingers into close proximity with the point where the components 86 and 88 are assembled for highly accurate positioning of fabrics on the guide plate 22 without substantial safety risks. For these reasons, the machine 10, specifically the upper tool and jaw assembly 12 thereof, represents a signification improvement in the art which has substantial commercial application.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a machine for assembling and attaching fastener components to a fabric and the like wherein the machine is of the type having upper and lower fastener tools, upper and lower feed assemblies which sequentially feed upper and lower component halves to said tools, respectively, and a guide plate for supporting said fabric and the like adjacent the upper end of said lower tool and wherein said upper tool reciprocates to effect sequential assembly of said upper and lower component halves with said fabric and the like therebetween, the invention comprising a stationary housing having a longitudinal passage therethrough, a pair of finger members mounted in said housing for receiving successive upper halves from said upper feed assembly and releasably positioning same in said passage, and means on said upper tool for temporarily retaining an upper component half on the lower end thereof, said housing being mounted on said machine and dimensioned so that the lower end thereof is spaced slightly above said guide plate, said upper tool being reciprocal in said passage whereby as said upper tool moves downwardly, said retaining means engages the component half held by said fingers and advances it downwardly through said passage and into assembled engagement with said lower half.

2. In the machine of claim 1, said finger members being pivotally mounted to said housing adjacent said passage, so that the lower ends of said finger members are pivotable inwardly and outwardly.

3. In the machine of claims 1 or 2 said finger members being inwardly biased.

4. In the machine of claim 3, said finger members further characterized as having inwardly directed jaw elements on the lower portions thereof which cooperate to receive and position said upper halves in said passage.

5. In the machine of claim 4, said jaw elements having transverse notches on the inner surfaces thereof for receiving said upper component halves.

6. In the machine of claim 5, said housing having a feed aperture communicating with said passage adjacent said notches in said jaw members.

7. In the machine of claim 1, said upper tool having an axial recess in the lower end thereof for receiving the upper portions of said upper halves and a longitudinal groove therein which terminates at the lower end of said upper tool, said retaining means comprising a resilient wire element which is disposed in said groove and which engages said upper halves to temporarily retain said upper half upper portions in said recess, and to temporarily maintain said upper halves in said aligned relation.

8. In the machine of claim 1, said housing having a slot therein for clearing jammed component halves from said assembly.

9. In the machine of claim 1, the spacing between the lower end of said housing and said guide plate being less than $\frac{3}{8}$ inch.

10. In the machine of claim 1, the spacing between the lower end of said housing and said guide plate being approximately $\frac{1}{4}$ inch.

* * * * *